US008460756B2

(12) United States Patent
Jeffery et al.

(10) Patent No.: US 8,460,756 B2
(45) **Date of Patent: *Jun. 11, 2013**

(54) METHOD FOR PRODUCING A PATTERN ON AN ENDLESS STRIP

(75) Inventors: John Jeffery, Blackburn Lancashire (GB); David Stuart Ponton, Blackburn Lancashire (GB); Douglas Stephen, Blackburn Lancashire (GB); Andrew Allum, Darwen Lancashire (GB); Antony Morton, Ben Rhydding Lancashire (GB)

(73) Assignee: Voith Patent GmbH, Heidenheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/985,148

(22) Filed: Jan. 5, 2011

(65) Prior Publication Data

US 2011/0244132 A1 Oct. 6, 2011

Related U.S. Application Data

(63) Continuation of application No. PCT/EP2009/058560, filed on Jul. 7, 2009.

(30) Foreign Application Priority Data

Jul. 7, 2008 (DE) ..... 10 2008 040 226
Mar. 17, 2009 (DE) ..... 10 2009 001 608

(51) Int. Cl.
*D21F 11/00* (2006.01)
*D21F 11/006* (2006.01)

(52) U.S. Cl.
USPC ..... 427/288; 427/256; 427/282; 427/428.01; 162/100; 162/134; 162/202

(58) Field of Classification Search
None
See application file for complete search history.

(56) References Cited

U.S. PATENT DOCUMENTS 3,926,111 A * 12/1975 Bohm ..... 101/116
4,111,634 A * 9/1978 Limbach et al. ..... 425/505

(Continued)

FOREIGN PATENT DOCUMENTS

CN 1555443 A 12/2004
CN 101146955 A 3/2008

(Continued)

OTHER PUBLICATIONS

Communication dated Oct. 19, 2009 (in German) from International Search Authority including International Search Report (dated Oct. 19, 2009) and Written Opinion of International Search Authority in PCT/EP2009/058560 (11 pages).

(Continued)

*Primary Examiner* — Nathan Empie
*Assistant Examiner* — Lisha Jiang
(74) *Attorney, Agent, or Firm* — Taylor IP, P.C.

(57) ABSTRACT

The invention relates to a method for producing a topographical pattern from polymer material on an endless strip with a longitudinal direction and a transverse direction extending perpendicularly thereto, in which method a cylindrical rotary screen is used to apply the polymer material by the screen printing process to a circumferential side of the endless strip to be printed, wherein, when producing the pattern, the rotary screen, rotating repeatedly about its longitudinal axis, rolls on the circumferential side of the endless strip, whereby the pattern is applied to the circumferential side in at least one path running at least once uninterruptedly around the circumferential side in such a way that the beginning and the end of each revolution of the path are arranged along a common straight line, wherein, when rolling, the rotary screen performs N revolutions about its longitudinal axis during each revolution of the path on the circumferential side of the endless strip and N is a positive integer.

15 Claims, 7 Drawing Sheets

U.S. PATENT DOCUMENTS

| | | | |
|---|---|---|---|
| 4,300,982 | A | 11/1981 | Romanski |
| 4,680,806 | A | 7/1987 | Bolza-Schunemann |
| 6,344,241 | B1 | 2/2002 | Ampulski |
| 2001/0051224 | A1 | 12/2001 | Ampulski |
| 2004/0081759 | A1 | 4/2004 | Maruyama et al. |
| 2006/0182936 | A1 | 8/2006 | Payne et al. |
| 2007/0170610 | A1 | 7/2007 | Payne et al. |
| 2011/0250355 | A1 | 10/2011 | Allum et al. |
| 2012/0073776 | A1 | 3/2012 | Jeffrey et al. |

FOREIGN PATENT DOCUMENTS

| | | | |
|---|---|---|---|
| CN | 102089475 | B | 10/2012 |
| DE | 10 2007 055 864 | A1 | 6/2009 |
| DE | 10 2008 040 973 | A1 | 2/2010 |
| EP | 2 304 104 | B1 | 2/2012 |
| WO | 95/11183 | A1 | 4/1995 |
| WO | 00/75423 | A1 | 12/2000 |
| WO | 2008068074 | A1 | 6/2008 |
| WO | 2009/077216 | A1 | 6/2009 |
| WO | 2010/015555 | A2 | 2/2010 |

OTHER PUBLICATIONS

International Search Report (in English) dated Oct. 19, 2009 in PCT/EP2009/058560 (2 pages).

English translation of International Preliminary Report on Patentability dated Jan. 18, 2011 for PCT/EP2009/058560 (6 pages).

English translation of Written Opinion of the International Searching Authority (undated) for PCT/EP2009/058560 (5 pages).

International Search Report dated Feb. 3, 2010 for PCT/EP2009/059803 (3 pages).

English translation of International Preliminary Report on Patentability dated Feb. 8, 2011 for PCT/EP2009/059803 (9 pages).

English translation of Written Opinion of the International Searching Authority for PCT/EP2009/059803 (8 pages).

* cited by examiner

METHOD FOR PRODUCING A PATTERN ON AN ENDLESS STRIP

CROSS REFERENCE TO RELATED APPLICATIONS

This is a continuation of PCT application No. PCT/EP2009/058560, entitled "METHOD FOR PRODUCING A PATTERN ON AN ENDLESS STRIP", filed Jul. 7, 2009, which is incorporated herein by reference.

BACKGROUND OF THE INVENTION

1. Field of the Invention

The invention relates to a method for producing a topographical pattern of polymer material on an endless strip.

2. Description of the Related Art

In particular for the production of tissue paper, use is made of screens having decorative topographical patterns. This enables production of tissue paper into which the topographical pattern of the screen is impressed.

The prior art discloses various options for applying the topographical pattern to an endless strip. For example, it is conceivable to apply the topographical pattern by means of a screen printing method or by means of extrusion dies.

Current papermachine fabrics often have widths of 10 meters or more. By contrast, printing screens are generally one meter wide at maximum. Therefore, the printing screens used in screen printing methods generally extend only over part of the width of the endless strip, for which reason the topographical pattern for the known fabrics is generally formed from a plurality of web-shaped pattern sections arranged next to one another. The problem here is that the elements of pattern sections arranged next to one another are frequently sharply offset relative to one another. This offset of the pattern elements of the individual pattern sections damages the vision impression of the tissue paper produced on such papermachine fabrics.

What is needed in the art is a method for producing a topographical pattern of polymer material on an endless strip, in which the pattern elements of pattern sections arranged next to one another are virtually not offset with respect to one another or are not offset at all.

SUMMARY OF THE INVENTION

The present invention provides the following method for producing a topographical pattern of polymer material on an endless strip:

An endless strip with a circumferential side which is to be printed is provided. The endless strip has a longitudinal direction and a transverse direction extending perpendicularly thereto.

In the method, use is made of a rotary screen, the cylindrical surface area of which has a perforation pattern which defines the topographical pattern. The perforation pattern, as viewed in the circumferential direction of the surface area, is formed by one perforation pattern section or by a plurality of consecutive, identical perforation pattern sections.

In order to produce the topographical pattern on a circumferential side of the endless strip, the polymer material is pressed in a liquid or pasty state through perforations in the surface area of the rotary screen while the rotary screen, rotating repeatedly about the longitudinal axis thereof, rolls with the surface area thereof on the circumferential side of the endless strip in at least one path revolving at least once uninterruptedly on the circumferential side of the endless strip. In this case, a revolving path has one or more path revolutions, wherein each path revolution has a beginning and an end.

The present invention is characterized in that, for each path revolution of the rotary screen on the circumferential surface of the endless strip, the beginning and the end of the respective path revolution is arranged along a common straight line and, when rolling, the rotary screen makes N/M revolutions about the longitudinal axis thereof during each path revolution on the circumferential side of the endless strip, with N and M each being a positive whole number, and with M indicating the number of perforation pattern sections which are arranged consecutively in the circumferential direction of the surface area of the rotary screen.

The amount of positive whole numbers corresponds here to the set of numbers $\{1, 2, 3, 4, \ldots\}$ in the mathematical sense.

The effect achieved by the solution according to the present invention is that the rotary screen completes N/M revolutions about the longitudinal axis thereof during each path revolution on the circumferential side of the endless strip, with M indicating the number of perforation pattern sections which are arranged consecutively in the circumferential direction of the surface area of the rotary screen.

Since, during rolling of the rotary screen on the circumferential side of the endless strip, every time when a perforation pattern section of the surface area of the rotary screen rolls fully on the endless strip, a section of the topographical pattern (called "topographical pattern section" below) is formed on the circumferential side of the endless strip, the effect achieved by the solution according to the invention is that, upon each completed path revolution of the rotary screen on the circumferential side of the endless strip, an integral multiple of consecutively arranged and identical topographical pattern sections are produced.

The effect achieved by the fact that, for a respectively viewed path revolution, the beginning and the end of said path revolution is arranged along a common straight line is that, after each path revolution, the end of the topographical pattern section formed last during the path revolution, as viewed in the direction of the path revolution, adjoins the beginning of the topographical pattern section formed first during said path revolution without being offset. The term "without being offset" is to be understood here as meaning that, as viewed in the direction of the path revolution, the end of the topographical pattern section formed last during a path revolution adjoins the beginning of the topographical pattern section formed first during said path revolution without being spaced apart, or that the topographical pattern section formed last during the path revolution viewed adjoins the topographical pattern section formed first during said path revolution without overlapping said first pattern section.

It is therefore possible by means of the solution according to the present invention to apply a topographical pattern to the endless strip without the pattern elements forming the pattern being offset.

It is conceivable that, for different path revolutions, at least two of the straight lines defining the respective beginnings and ends run with an offset to each other, in particular with an offset parallel to each other. This can specifically mean, for example, that, for a first path revolution, the beginning and the end of the first path revolution is arranged along a first straight line, wherein, for a second path revolution, the beginning and the end of the second path revolution is arranged along a second straight line, and wherein the first straight line runs, for example, with an offset parallel to the second straight line.

It is conceivable, according to a particularly preferred refinement of the invention, that the beginnings and the ends of all of the path revolutions are arranged along a common straight line.

It is conceivable for the endless strip to be made endless by means of a pintle seam. The endless strip can be woven to be flat or endless. If the endless strip is woven, for example, to be flat, it can be made endless, for example, by means of a woven seam connection.

The endless strip with the topographical pattern is preferably used as papermachine fabric, in particular for the production of tissue paper.

Protection is furthermore provided for an endless strip, in particular a fabric for a paper, board or tissue machine, which endless strip is produced by the method according to the invention.

The endless strip which is provided with the topographical pattern can be used here in particular as a DSP screen or as a TAD screen. The topographical pattern here preferably constitutes a decorative pattern, by means of which, during the production and/or treatment of a fibrous material web, in particular tissue web, a decorative pattern is produced in the fibrous material web. Accordingly, the circumferential side which is to be printed can be the paper side of the endless strip.

If a wearing volume is intended to be provided on the machine side of the endless strip by means of the topographical pattern, the circumferential side which is to be printed can also be the machine side of the endless strip.

The rotary screen is preferably designed as a circular cylinder, in particular as a rectilinear circular cylinder, and the length thereof extends preferably only over part of the width of the endless strip. The length of the rotary screen can be, for example, between 0.2 and 3 meters, in particular between 0.3 and 1 meter, for example 0.5 meter.

Depending on how the rotary screen rolls on the circumferential side of the endless strip, different options are conceivable as to how the beginning and the end of each path revolution can be arranged.

In a first option, the common straight line along which the beginnings and the ends of all of the path revolutions are arranged runs in the transverse direction of the endless strip. In this case, i.e. as viewed in the longitudinal direction of the endless strip, the beginning and the ends of each path revolution are always arranged at the same position.

This can be achieved, for example, by, during rolling of the rotary screen on the circumferential side, the longitudinal axis of the rotary screen being oriented perpendicularly to the longitudinal direction of the endless strip.

Furthermore, it is possible in particular that the rotary screen rolls on the circumferential side in an uninterrupted, helical path, in particular over the entire width to be printed of the endless strip, and, when rolling on the circumferential side, the rotary screen is displaced in the transverse direction of the endless strip in such a manner that the adjacent path revolutions of the helical path are added to the topographical pattern.

In this case, the helical path is produced by the rotary screen being moved in the transverse direction of the endless strip during the production of the pattern while rotating about the longitudinal axis thereof which is oriented perpendicularly to the longitudinal direction of the endless strip. The rotary screen is therefore moved in the transverse direction of the endless strip here without a rotational component directed in the transverse direction of the endless strip.

It is in particular possible in this case for the beginnings and the ends of all of the path revolutions to be arranged on a common straight line extending in the transverse direction of the endless strip, wherein, as viewed for each path revolution, the beginning and end of said path revolution are offset with respect to each other by the width of the path.

According to a further refinement of the invention, it is conceivable that the rotary screen is rolled on the circumferential side of the endless strip in a plurality of paths arranged next to one another, with each path making only one path revolution on the circumferential side to be printed, and, between the application of two paths arranged next to each other, the rotary screen is displaced in the direction of the width of the endless strip, in particular by the path width.

Also in this case, the rotary screen rotates about the longitudinal axis thereof which is oriented perpendicularly to the longitudinal direction of the endless strip, wherein, in this case, movement in the transverse direction is only carried out if the rotary screen has produced a closed path and has to be brought into a position for producing an adjacent path.

In this refinement of the invention, it is conceivable that the beginnings and the ends of all of the path revolutions are arranged along a common straight line, wherein, as viewed for each path revolution, the beginning and end thereof are not offset with respect to each other in the transverse direction of the endless strip. As an alternative thereto, it is conceivable that, for different path revolutions, at least two of the straight lines which define the respective beginnings and ends and extend in particular in the transverse direction of the endless strip run at an offset parallel to each other, wherein, as viewed for each path revolution, the beginning and end thereof are not offset with respect to each other in the transverse direction of the endless strip.

In a further option, the common straight line along which the beginnings and the ends of all of the path revolutions are arranged encloses an angle of greater than 0° and smaller than 90° with the transverse direction of the endless strip. In this case, the beginnings and the ends of all of the path revolutions are arranged on a common straight line extending obliquely with respect to the transverse direction of the endless strip.

It is also possible in this case that the rotary screen rolls on the circumferential side in an uninterrupted, helical path, in particular over the entire width to be printed of the endless strip, and, when rolling on the circumferential side, the rotary screen is displaced in the transverse direction of the endless strip in such a manner that the adjacent path revolutions of the helical path are added to the topographical pattern.

This can be achieved, for example, by, during rolling of the rotary screen on the circumferential side, the longitudinal axis of the rotary screen not being oriented parallel but rather obliquely with respect to the transverse direction of the endless strip. This means that, when rolling on the circumferential side, the rotary screen rotates about the longitudinal axis thereof which is oriented obliquely with respect to the transverse direction of the endless strip.

In this case, the beginnings and the ends of all of the path revolutions are therefore arranged on a common straight line, wherein, as viewed for each path revolution, the beginning and end thereof in each case are offset with respect to each other by the width of the path. In this case, the common straight line encloses an angle of greater than 0° and smaller than 90° with the transverse direction of the endless strip.

In the abovementioned refinements, mutually adjacent path revolutions are preferably arranged abutting each other. This has the effect that the adjacent path revolutions are added to the topographical pattern.

It is provided, according to a specific refinement of the invention, that, when rolling on the circumferential side, the surface area of the cylindrical rotary screen moves at a circumferential speed and that the endless strip revolves at a transport speed, which is oriented parallel to the longitudinal direction thereof, around at least two rolls which are spaced apart from each other and are oriented parallel to each other. In this case, the circumferential speed and the transport speed are coordinated with each other in such a manner that the rotary screen makes N/M revolutions about the longitudinal axis thereof during each revolution on the circumferential side of the endless strip and N and M are each a positive whole number.

The circumferential speed and transport speed are coordinated here preferably taking into consideration the quotient of the length of a path revolution and the length of one of the identical perforation pattern sections of the surface area of the circular-cylindrical rotary screen.

If the rotary screen produces the topographical pattern here in a helical path, then it is possible to differentiate, for example, the following two cases:

a) The longitudinal axis of the rotary screen is oriented perpendicularly to the longitudinal direction of the endless strip:

In this case, as viewed in the longitudinal direction of the endless strip, the beginning and the end of each path revolution are arranged at the same position. In this case, the circumferential speed of the surface area of the rotary screen and the transport speed of the endless strip can be coordinated taking into consideration the quotient of the circumference of the endless strip and the length of a perforation pattern section in the circumferential direction of the surface area of the cylindrical rotary screen.

If the rotary screen produces the topographical pattern in a plurality of paths which are arranged next to one another and are in each case closed per se, then the circumferential speed and transport speed are coordinated incorporating the circumference of the endless strip and the length of a perforation pattern section, as viewed in the circumferential direction of the surface area of the cylindrical rotary screen.

b) The longitudinal axis of the rotary screen is not oriented perpendicularly to the longitudinal direction of the endless strip:

In this case, as viewed in the longitudinal direction of the endless strip, the beginning and the end of each path revolution are arranged at different positions, to be precise depending on at which position the rotary screen is in, as viewed in the transverse direction of the strip. In this case, the circumferential speed and transport speed can be coordinated incorporating the circumference of the endless strip, the angle which the longitudinal axis of the rotary screen and the longitudinal direction of the endless strip enclose with each other and the length of a perforation pattern section in the circumferential direction of the surface area of the cylindrical rotary screen.

The circumferential speed and transport speed are preferably coordinated in such a manner that, given a quotient of the length of a path revolution and the length of a perforation pattern section in the circumferential direction of the surface area of the cylindrical rotary screen that is not equal to a positive whole number, the circumferential speed and the transport speed are not equal. In this case, the effect therefore achieved by a difference between the circumferential speed and transport speed and a relative movement resulting therefrom at the moment of transfer of the polymer material from the rotary screen to the endless strip is that, when rolling, the rotary screen makes N/M revolutions about the longitudinal axis thereof during each path revolution on the circumferential side of the endless strip, with N, M each being a positive whole number.

In specific terms, this can mean that, given a quotient with a number after the decimal point of less than 5, the circumferential speed is adjusted to be lower than the transport speed. Furthermore, this can mean that, given a quotient with a number after the decimal point of greater than 5, the circumferential speed is set to be greater than the transport speed.

The rotary screen is preferably arranged at a location at which the endless strip is not guided around a roll. Furthermore, it is provided, according to a specific refinement of the invention, that the rotary screen together with a counter roll forms a nip through which the endless strip is guided for the application of the polymer material.

In particular in order to ensure the lateral connection of path revolutions arranged next to one another in the transverse direction of the endless strip without the pattern elements being offset with respect to one another, it is expedient if the perforation pattern of the rotary screen which defines the topographical pattern, as viewed in the longitudinal extent of the rotary screen, is delimited by an end on one end side and an end on the other end side, the end on one end side of the perforation pattern constituting the continuation of the end on the other end side of the perforation pattern. This aspect can also constitute a further aspect of the invention which is independent of the aspect of claim 1 and therefore does not necessarily have to be coupled to the aspect of claim 1.

As already explained, the endless strip can revolve at a transport speed around two rolls which are spaced apart from each other and in particular are arranged parallel to each other. It is furthermore conceivable that the rolls are mounted together with the rotary screen on a frame, wherein the rotary screen and the rolls are arranged in a fixed position with respect to each other, as viewed in the machine direction of the frame. Furthermore, it is conceivable, during the production of the pattern, for the rotary screen to be moved relative to the rolls in the machine transverse direction of the frame. During the production of the pattern, the rotary screen can move continuously or in a stepwise manner in the machine transverse direction of the frame.

Rollers are preferably arranged between the two spaced-apart rolls about which the endless strip revolves, on which rollers the endless strip is supported on at least one route between the two rolls.

In particular, the endless strip is supported on the rollers between the rolls on both routes, i.e. on the upper and the lower route. In this case, the endless strip comes into contact with the rollers on the upper route by means of its circumferential side which is opposite the circumferential side to be printed. Furthermore, the endless strip comes into contact with the rollers on the lower route by means of its printed circumferential side.

Since the rollers are each mounted rotatably about the longitudinal axis thereof, the topographical pattern is protected on the lower route.

The circumference of the endless strip is preferably measured before the circumferential speed and transport speed are coordinated.

According to a further refinement of the invention, it can be provided that the endless strip is subjected to a heat treatment while revolving around the rolls.

Furthermore, in a preferred refinement of the invention, the endless strip is under a tensile stress in the longitudinal direction thereof while revolving around the rolls. In this case, the endless strip is preferably under a tensile stress during the heat treatment, with the maximum tensile stress and maximum temperature being lower during the heat treatment than the maximum tensile stress and maximum temperature during a preceding thermofixing of the endless strip.

Typical values in this context are, for example, a maximum temperature during the heat treatment of approximately 160° C. with a maximum tensile stress of approximately 1 kN/m, wherein, during the thermofixing, the maximum temperature is approximately 180° C. and the maximum tensile stress is 1.5-2 kN/m. The abovementioned values are advantageous in particular for an endless strip embodied as a spiral link fabric.

According to a further refinement, during the thermofixing, the endless strip, after having been drawn in the longitudinal direction thereof at the maximum tensile stress can be drawn at a lower tensile stress than the maximum tensile stress. In this case, in particular in spiral link fabrics, the lower tensile stress can be within the range of 0.5-1.0 kN/m.

If, for example, use is made of an endless strip embodied as a woven fabric, the maximum tensile stress during the heat treatment can be increased to up to 7 kN/m. Accordingly, a preferred refinement of the present invention makes provision for the endless strip to be under a tensile stress in the range of 0.5-7.0 kN/m during the heat treatment in order to cure the applied polymer material.

In order to be able to hold the endless strip at a constant width while it revolves under tensile stress around the rolls, in a preferred development of the invention, the endless strip, which is under tensile stress in the longitudinal direction thereof, is held in the transverse direction thereof at a predetermined width or a predetermined width range by suitable means. The holding of the endless strip in the transverse direction thereof is expedient in particular in the case of an endless strip which is embodied as a woven fabric and has thread knuckles.

The polymer material is preferably applied in a liquid or pasty state to the endless strip by means of the rotary screen and is then subjected to a thermal and/or to a chemical activation treatment for the solidification thereof.

The polymer material is preferably silicone or polyurethane.

During application to the endless strip, the polymer material preferably has a viscosity within the range of 20 000-80 000 cps, particularly preferably within the range of 50 000-60 000 cps.

The polymer material applied to the endless strip can be, for example, thermally and/or chemically activated for the solidification thereof.

During the revolving thereof around the two rolls, the endless strip is preferably guided past a radiation source for the thermal and/or chemical activation of the polymer material.

It should be mentioned in this context that liquid or pasty silicone can be solidified by heat treatment, for example by means of IR radiation. Furthermore, liquid or pasty polyurethane can be solidified by chemical activation, for example by means of UV radiation.

In this case, the radiation source preferably points toward that circumferential side of the endless strip which is to be printed or is at least partially printed. In addition, a sheetlike counter element can be provided which is arranged opposite the radiation source in such a manner that the endless strip is guided through a space delimited by the radiation source and the counter element. In this case, the circumferential side pointing away from that circumferential side of the strip which is to be printed points toward the counter element, i.e. the endless strip is guided through between the radiation source and the sheetlike counter element. This method has proven worthwhile in practice in particular for an endless strip embodied in the form of a spiral link fabric.

The counter element here can have the effect that the heat emitted by the radiation source is trapped in the space and is uniformly distributed and/or that the radiation emitted by the radiation source is reflected in the direction of the endless strip.

The counter element can be made, for example, of a material which rather reflects than absorbs radiation. The sheetlike counter element can be embodied, for example, in the form of a textile or non-textile sheetlike structure. By way of example, a woven fabric is used as the textile sheetlike structure. A sheet or a plate can be used by way of example as the non-textile sheetlike structure. The counter element may be white, for example, on the side thereof which points toward the endless strip.

In order to achieve a uniform longitudinal extent over the width of the endless strip, it is in particular expedient if the endless strip is exposed uniformly over the entire width thereof to the radiation. This is expedient in particular if the endless strip is heated by the radiation.

In order to arrive at a precise statement regarding the circumference of the endless strip, it is expedient in particular if the endless strip is subjected to a heat treatment prior to the circumference thereof being measured, wherein the circumference of the endless strip is measured after the circumference has been set to a constant value. The circumference is preferably measured here before the topographical pattern is applied to the endless strip. This is expedient in particular whenever the endless strip is subjected to a heat treatment in order to solidify the polymer material.

The circumference of the endless strip is typically greater than 10 meters, in particular greater than 30 meters. Furthermore, the circumference of the surface area of the cylindrical rotary screen is typically smaller than 1 meter.

The endless strip is preferably a woven fabric or a spiral link fabric. The endless strip is preferably produced from at least one of the materials PET, PPS, PCT or PCTA.

In order to improve the monitoring of the application of polymer material and resultant reduction in the offset of pattern elements in the transverse direction of the endless strip, in a further preferred refinement of the invention, during the production of the pattern, the position of the endless strip is measured in a direction parallel to the transverse direction of the endless strip relative to a positionally fixed reference position, wherein, if there is a change in the position of the endless strip parallel to the transverse direction thereof, the position of the rotary screen is changed parallel to the transverse direction of the endless strip.

If, as described above, the rolls and the rotary screen are arranged on a common frame, it can be provided in particular that, during the production of the pattern, the position of the endless strip is measured in the machine transverse direction relative to the frame, wherein, if there is a change in the position of the endless strip in relation to a desired position, the position of the rotary screen is changed in the machine transverse direction of the frame or in the transverse direction of the endless strip. In other words, this means that, if a change in the position of the endless strip in relation to a desired position is detected, the position of the rotary screen is correspondingly corrected to compensate for the change in position of the endless strip.

The value and the direction of the change in the position of the rotary screen preferably correspond to the value and the direction by and in which the position of the endless strip has changed in the machine transverse direction of the frame or in the transverse direction of the endless strip.

One specific refinement of the invention makes provision for the position of the endless strip to be determined with reference to the position of one of the longitudinal edges thereof.

In order to determine the position of the endless strip use can be made, for example, of a light barrier with which the position of one of the longitudinal edges of the endless strip is measured.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
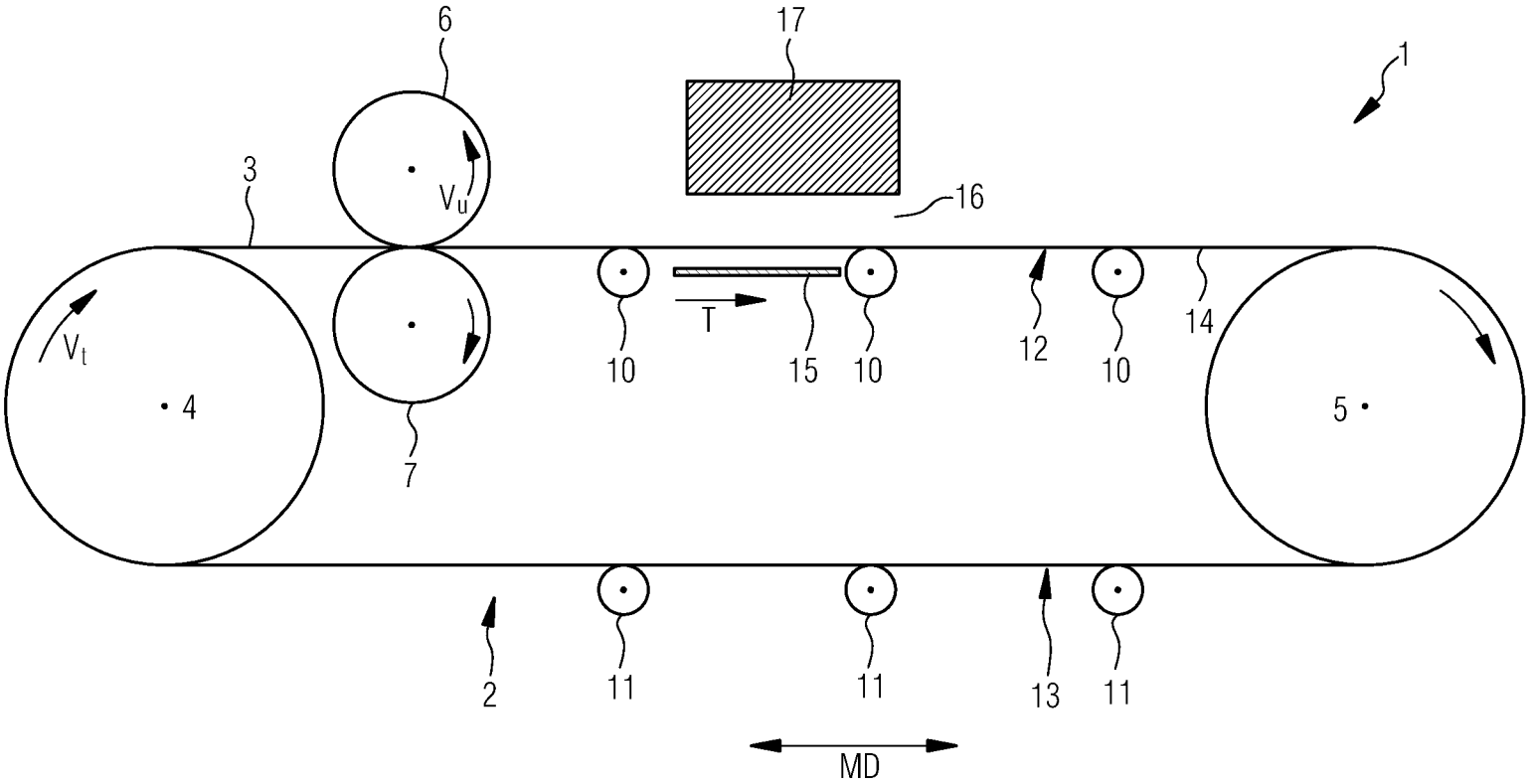
FIG. 1 shows an apparatus for carrying out the method according to the present invention, in side view.
Figure 2:
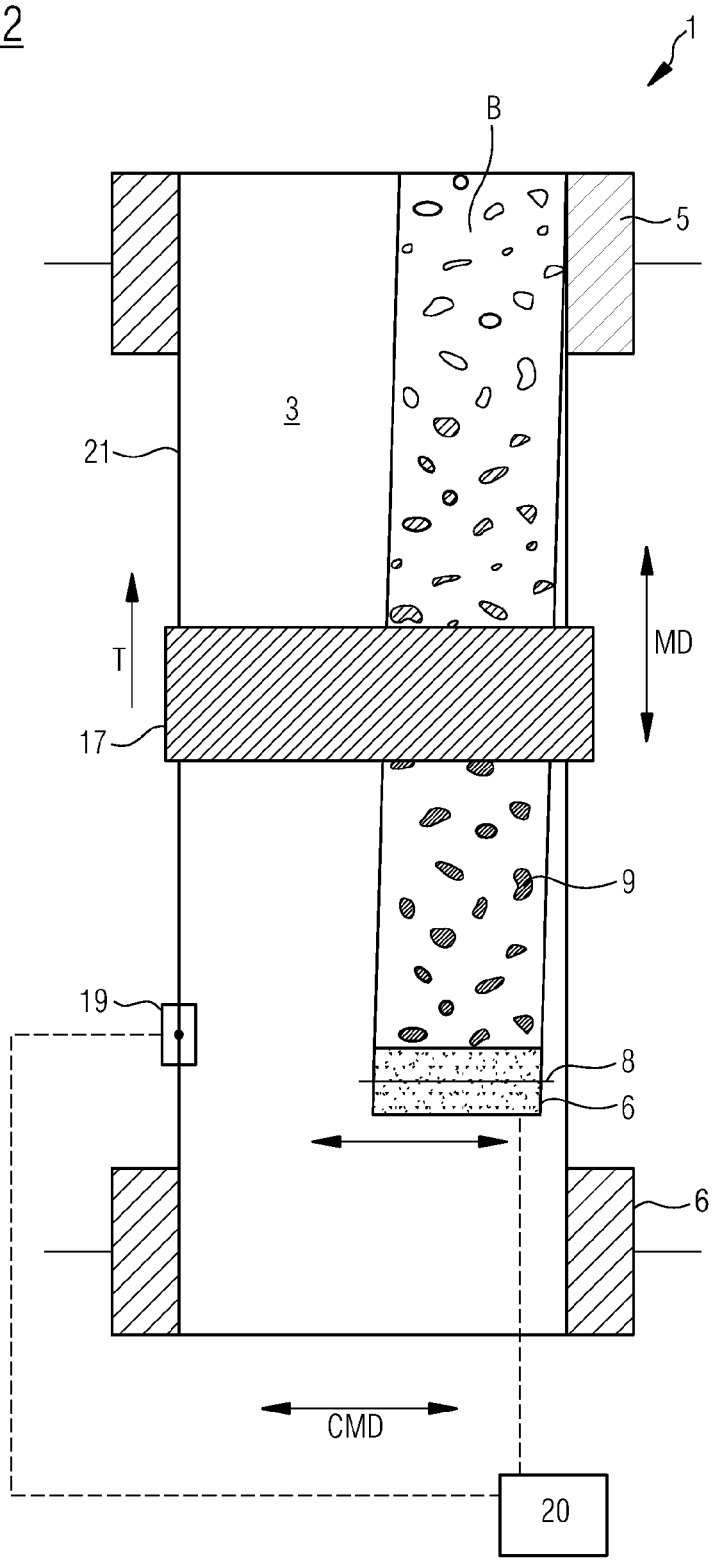
FIG. 2 shows the apparatus from FIG. 1 in top view.

Referring now to the drawings, and more particularly to FIG. 1, there is shown an apparatus 1 for carrying out the method according to the present invention, in side view. FIG. 2 shows the apparatus 1 from FIG. 1 in top view.

An endless strip 2 which is embodied in the form of a spiral link fabric and has a circumferential side 3 which is to be printed is guided around two rolls 4, 5 (in transport direction T) which are spaced apart from each other and are oriented parallel to each other. The endless strip has a longitudinal direction MD and a transverse direction CMD extending perpendicularly thereto.

The apparatus 1 comprises a perforated, cylindrical rotary screen 6 which is rotatable about the longitudinal axis 8 thereof and with which a polymer material 9 can be applied by a screen printing method to that circumferential side 3 of the endless strip 2 which is to be printed, thus forming a topographical pattern on the circumferential side 3.

During application, the polymer material 9 is in a liquid or pasty state and can have a viscosity within the range of 20 000-80 000 cps, particularly preferably within the range of 50 000-60 000 cps.

A counter roll 7 is provided in addition to the rotary screen 6, said counter roll together with the rotary screen 6 forming a nip through which the endless strip 2 is guided for the application of the polymer material 9.

In the present case, the rotary screen 6 is arranged at a location at which the endless strip 2 is not guided around one of the two rolls 4, 5.

The apparatus 1 has rollers 10, 11 between the two spaced-apart rolls 4, 5, around which the endless strip 2 revolves, on which rollers the endless strip 2 is supported on both routes between the rolls 4, 5, i.e. on an upper route 12 and on a lower route 13.

In this case, the endless strip 2 comes into contact with the rollers 10 on the upper route 12 by means of its circumferential side 14 which is opposite the circumferential side 3 which is to be printed. Furthermore, the endless strip 2 comes into contact with the rollers 11 on the lower route 13 by means of its at least partially printed circumferential side 3. The rollers 10, 11 are rotatable about the longitudinal axis thereof.

The endless strip 2 is subjected to a heat treatment while revolving around the rolls 4, 5. By means of the heat treatment, the polymer material 9 applied to the endless strip 2, this being silicone in the present case, is thermally activated, as a result of which said polymer material solidifies.

For the heat treatment, while revolving around the two rolls 4, 5, the endless strip 2 is guided past a radiation source 17 which, in the present case, produces IR radiation and emits the radiation in the direction of the circumferential side 3.

In addition, a sheetlike counter element 15 is provided which is arranged lying opposite the radiation source 17 in such a manner that the endless strip 2 is guided through a space 16 delimited by the radiation source 17 and the counter element 15. In this case, the circumferential side 14 which points away from that circumferential side 3 of the strip 2 which is to be printed points toward the counter element 15 which is embodied in the form of a white screen. That is to say, the endless strip 2 is guided through between the radiation source 17 and the screen 15.

In the present case, the counter element 15 has the effect that at least part of the heat produced by the radiation source 17 is trapped in the space 16 and is distributed uniformly and/or that at least part of the radiation emitted by the radiation source 17 is reflected in the direction of the endless strip 2.

In order to achieve a uniform longitudinal extent of the endless strip 2 over the width thereof, it is expedient in particular if the endless strip 2 is exposed uniformly over the entire width thereof to the radiation. This is expedient in particular whenever the endless strip is heated by the radiation.

Figure 3:
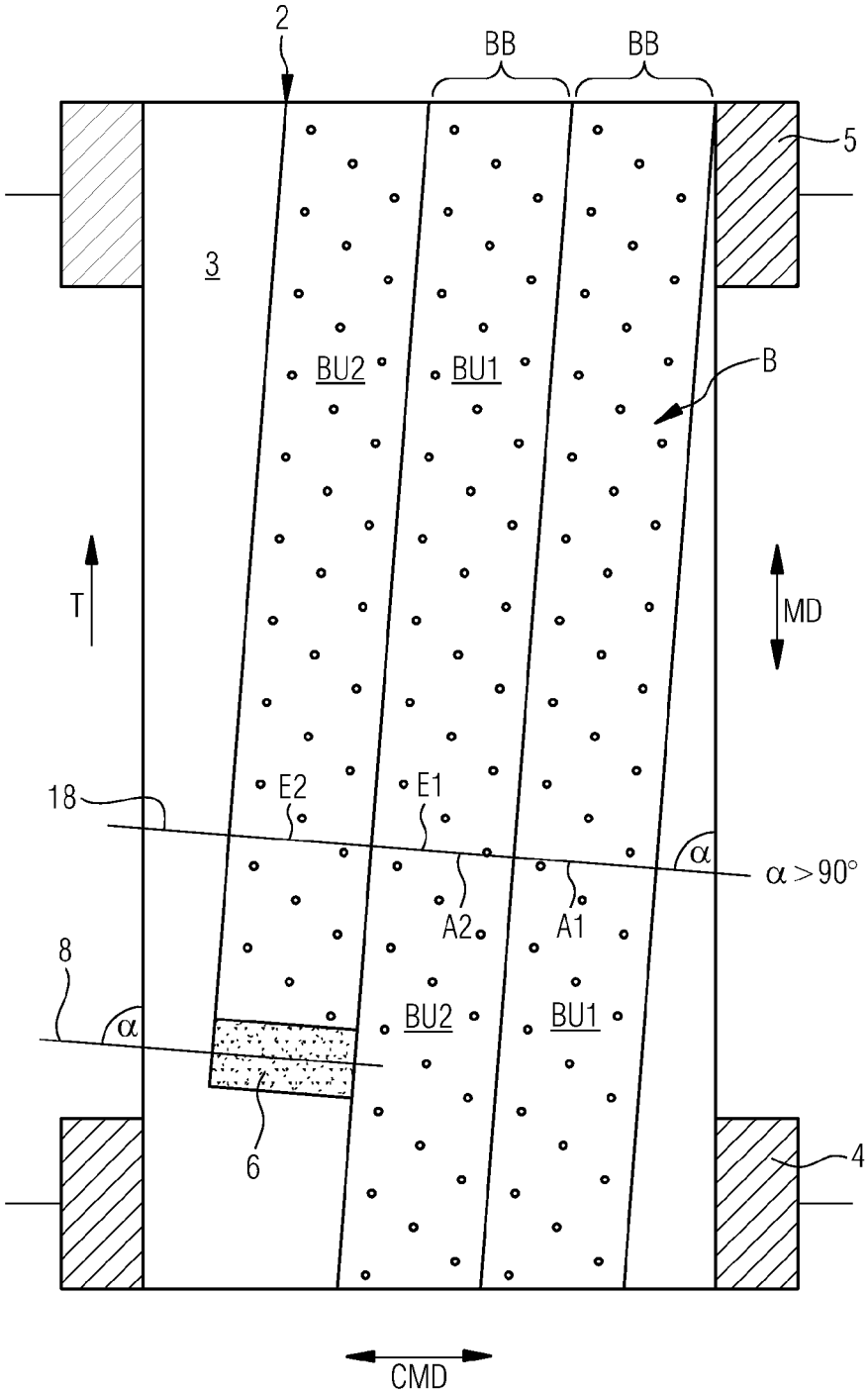
FIG. 3 shows a first version of the method according to the present invention.
Figure 4:
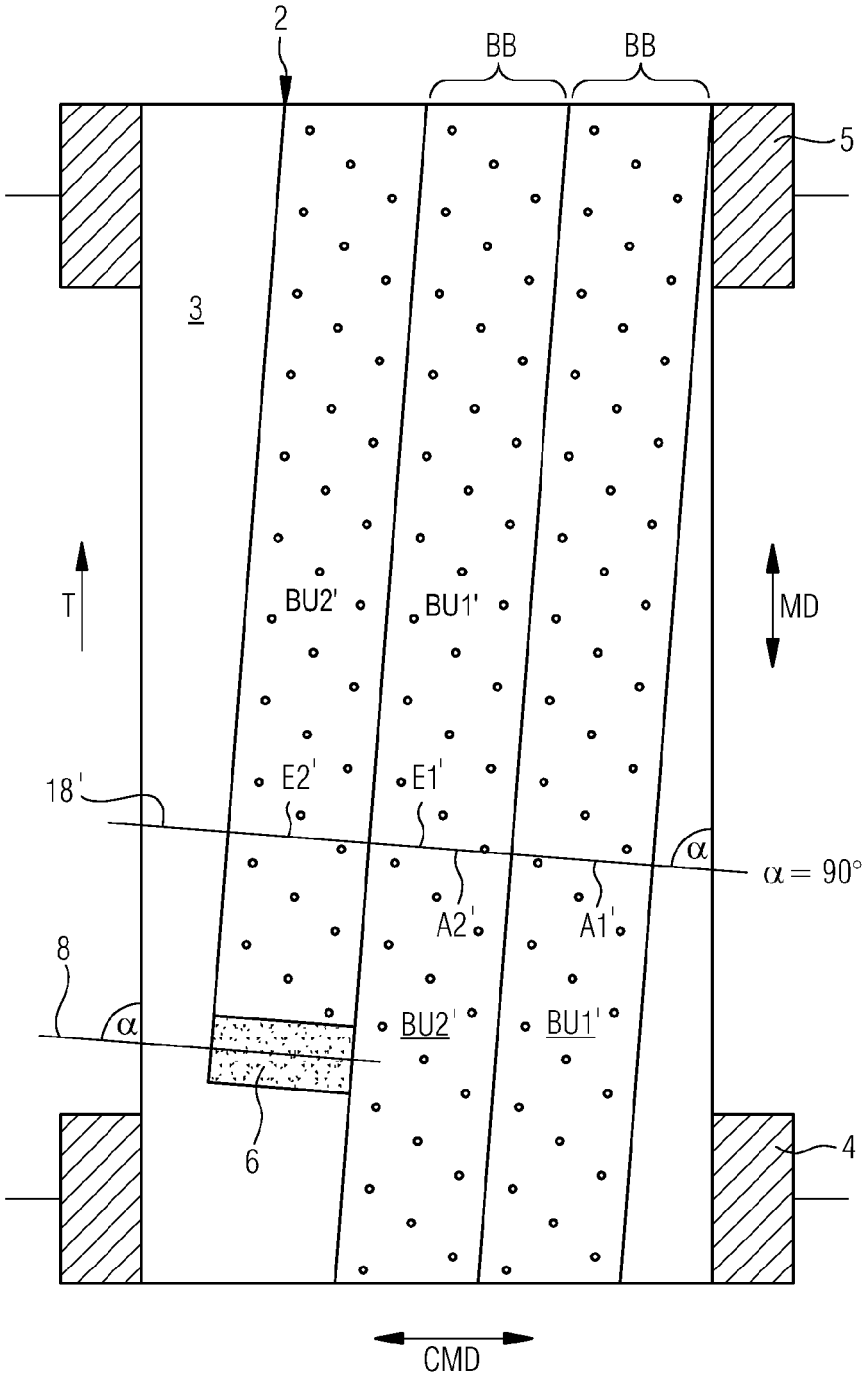
FIG. 4 shows a second version of the method according to the present invention.
Figure 5:
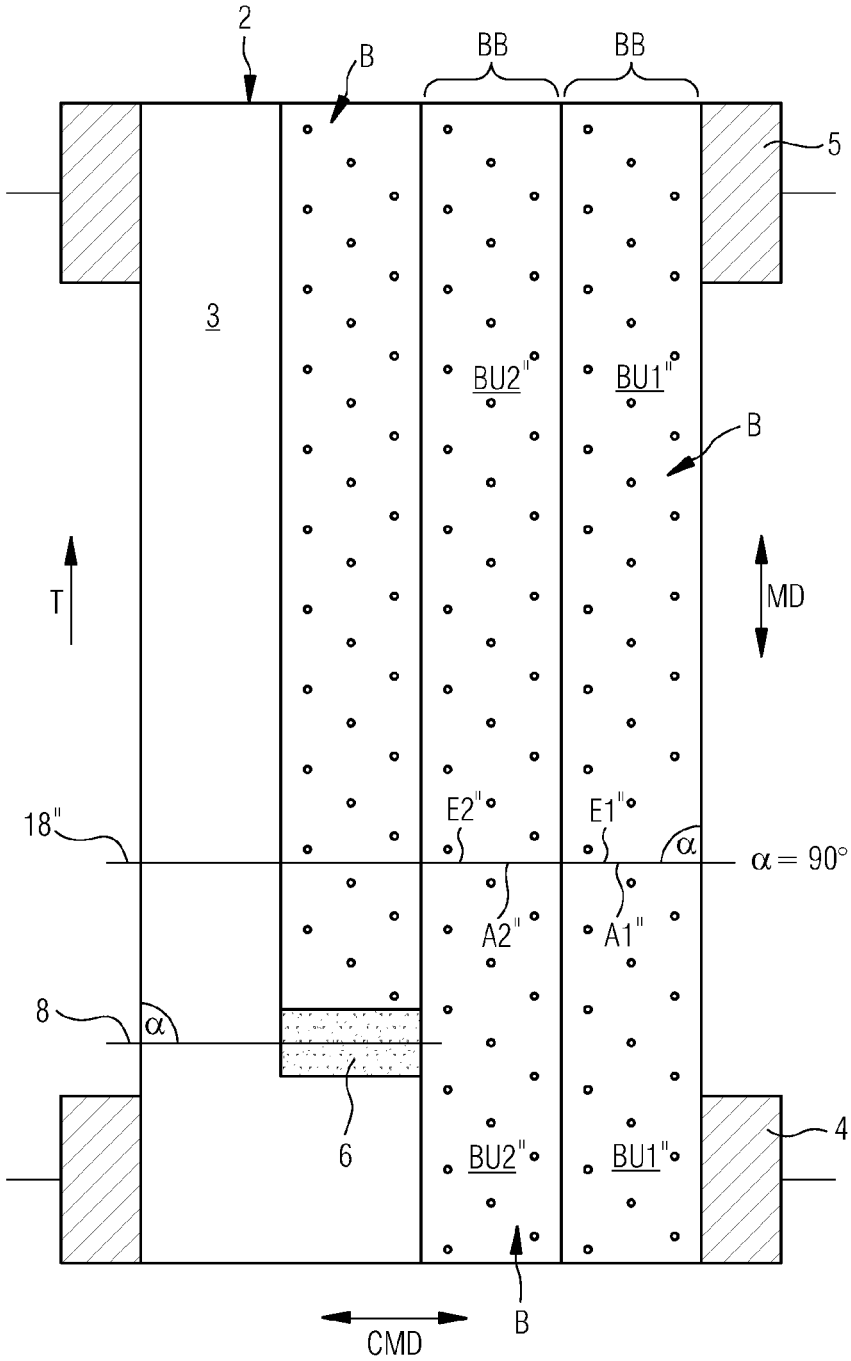
FIG. 5 shows a third version of the method according to the present invention.

During production of the pattern, the rotary screen 6, rotating repeatedly about the longitudinal axis 8 thereof, rolls on the circumferential side 3 of the endless strip 2, as a result of which at least part of the pattern is applied on the circumferential side 3 in at least one path B revolving at least once uninterruptedly on the circumferential side 3 in such a manner that the beginning A and the end E of each path revolution BU are arranged along a common straight line 18 (see FIGS. 3-5).

The rotary screen 6 here is moved either continuously or in a stepwise manner in the transverse direction CMD of the endless strip.

The apparatus 1 furthermore has a light barrier 19 by means of which, during the production of the pattern, the position of the endless strip 2 relative to a positionally fixed reference position is measured in a direction parallel to the transverse direction CMD of the endless strip 2. The reference position can be defined, for example, by a position in the machine transverse direction of the machine frame (not illustrated) on which the rolls 4, 5 and the holder of the rotary screen 6 are mounted. Both the light barrier 19 and the displacement unit with which the rotary screen is movable in the machine transverse direction of the frame or in the transverse direction of the endless strip 2 (note: the machine transverse direction of the frame and the transverse direction of the endless strip coincide here) are connected to a control device 20. The control device has the effect that, if there is a change in the position of the endless strip 2 parallel to the transverse direction CMD thereof, the position of the rotary screen 6 is changed parallel to the transverse direction of the endless strip 2, wherein, in the present case, the value and the direction of the change in the position of the rotary screen 6 in CMD correspond to the value and the direction by and in which the position of the endless strip 2 has changed in the transverse direction CMD of the endless strip.

As can be seen from the illustration of FIG. 2, in the present case the position of the endless strip 2 is determined with reference to the position of one of the longitudinal edges 21 thereof.

In the illustrations shown in FIGS. 2-6, the circumferential side 3 of the endless strip 2 is only partially provided with the pattern. The regions with the pattern are marked by dots, the dots constituting the pattern.

Figure 7:
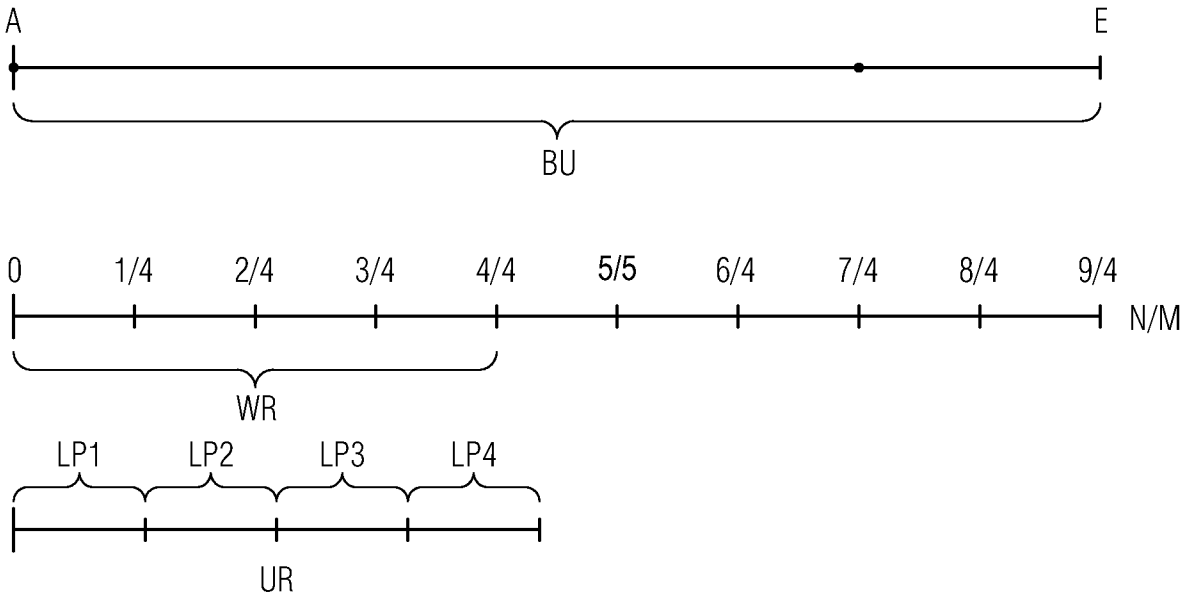
FIG. 7 schematically shows the principle according to the present invention.

FIG. 7 schematically shows the principle according to the present invention. A path revolution BU which extends from a beginning A to an end E can be seen on the upper straight line. The central straight line firstly shows the route WR which the rotary screen covers when it makes a revolution when rolling on the circumferential side of the endless strip. Secondly, the central straight line indicates the number N/M of revolutions made by the rotary screen 6 when rolling on the circumferential side 3 of the endless strip 2 during a path revolution BU.

Since the surface area of the rotary screen, seen in the circumferential direction of the surface area, is formed by M consecutive, identical perforation pattern sections, wherein M in the present case is equal to four, the rotary screen 6 is rolled, according to the invention, on the circumferential side 3 in such a manner that said rotary screen makes N/M revolutions, here 9/4=2¼ revolutions, about the longitudinal axis 8 thereof during each path revolution BU on the circumferential side 3 of the endless strip, with N, M each being a positive whole number.

The effect achieved by the solution according to the invention is that the rotary screen 6 rolls a plurality of perforation pattern sections on the circumferential side of the endless strip during each path revolution BU on the circumferential side 3 of the endless strip 2. The effect achieved by this is that a whole number of perforation pattern sections have been rolled on the circumferential side of the endless strip at the end E of each path revolution BU. Since the individual perforation pattern sections are identical to one another, they also form topographical pattern sections which are identical to one another. The effect achieved by this is that the topographical pattern section at the beginning A of the path revolution BU adjoins the topographical pattern section, which is identical thereto, at the end E of the path revolution BU without being offset.

In the example illustrated in FIG. 7, the rotary screen 6 makes 2¼ revolutions at the longitudinal axis 8 thereof during a path revolution BU. This means that BU=N/M×WR, with N, M each being a positive whole number.

The lower straight line in FIG. 7 indicates the circumference UR of the surface area of the rotary screen. As can be seen, the circumference UR is larger than the route WR which the rotary screen has to cover during one revolution of the rotary screen, and therefore the rotary screen rotates N/M times about the longitudinal axis thereof during a path revolution BU. The circumference of the surface area of the rotary screen is composed of the lengths LP1-LP4 of the perforation pattern sections which are identical to one another and are located consecutively in the circumferential direction. Consequently, the length LP1-LP4 are all identical.

In order to achieve this, for example, the following can be undertaken:

During rolling of the rotary screen 6 on the circumferential side 3 of the endless belt 2, the surface area of the rotary screen 6 rotates at a circumferential speed Vu. Furthermore, the endless strip 2 revolves at a transport speed Vt, which is oriented parallel to the longitudinal direction MD thereof, around the two rolls 4, 5, which are spaced apart from each other and are oriented parallel to each other. The circumferential speed Vu and the transport speed Vt are coordinated here with each other in such a manner that the rotary screen 6 makes N/M revolutions about the longitudinal axis 8 thereof during each path revolution BU on the circumferential side 3 of the endless strip and N and M are each a positive whole number.

In this case, the circumferential speed Vu and transport speed Vt are coordinated, for example, taking into consideration the quotient of the length of a path revolution BU and the circumference UR of the surface area of the circular-cylindrical rotary screen 6 and of the number M of identical perforation pattern sections arranged consecutively in the circumferential direction of the surface area.

If, for example, the length of the path revolution BU is identical to the circumference of the endless strip, then the circumferential speed Vu and transport speed Vt are coordinated, for example, taking into consideration the quotient of the circumference of the endless strip 2 and the circumference UR of the surface area and taking into consideration the number M of identical perforation pattern sections of the circular-cylindrical rotary screen 6 that are arranged consecutively in the circumferential direction of the surface area.

The various options for producing the pattern will be described in more detail below. It should be noted here that, depending on the method used, a path revolution BU can extend parallel to the longitudinal direction MD of the endless strip 2 or obliquely with respect thereto.

FIG. 3 shows a first version of the method according to the invention.

In the version illustrated in FIG. 3, the rotary screen 6 rolls on the circumferential side 3 in an uninterrupted, helical path B. The path B is formed by a multiplicity of mutually adjacent path revolutions, of which the path revolutions BU1 and BU2 are described in more detail here. Each path revolution BU1, BU2 is delimited in the length thereof by a beginning A and an end E. For example, the path revolution BU1 is delimited in the length thereof by the beginning A1 and the end E1. As can be seen from the illustration in FIG. 3, the ends E1, E2 and the beginnings A1, A2 of all of the path revolutions BU1, BU2 lie on a common straight line 18 which encloses an angle $\alpha \neq 90°$ with the longitudinal direction MD of the endless strip 2. In this case, the beginnings A1, A2 and the ends E1, E2 of all of the path revolutions BU1, BU2 are therefore arranged on a common straight line 18 extending obliquely with respect to the longitudinal and transverse directions of the endless strip 2. The beginning A1, A2 and the end E1, E2 of each path revolution BU1, BU2 are offset with respect to each other here in each case by the width BB of the path B.

During rolling of the rotary screen 6 on the circumferential side 3, said rotary screen is displaced in the transverse direction CMD of the endless strip 2 in such a manner that the adjacent path revolutions BU1, BU2 of the helical path B are added to the topographical pattern. In this case, mutually adjacent path revolutions BU1, BU2 are arranged abutting against each other.

In the present case, during the rolling of the rotary screen 6 on the circumferential side 3, the longitudinal axis 8 of the rotary screen 6 is not oriented parallel but rather obliquely with respect to the transverse direction CMD of the endless strip 2. In the present case, the longitudinal axis 8 of the rotary screen 6 encloses the angle α with the longitudinal direction MD of the endless strip 2. This means that, when rolling on the circumferential side 3, the rotary screen 6 rotates about the longitudinal axis 8 thereof which is oriented obliquely with respect to the longitudinal and transverse directions of the endless strip 2.

In the case shown in FIG. 3, the beginning and the end of each path revolution BU are located, as viewed in the longitudinal direction MD of the endless strip, at different locations, i.e. during each revolution of the endless strip 2 around the two rolls 4, 5, the position of the beginning A and of the end E of the path revolution BU changes, as viewed in the longitudinal direction MD of the endless strip, to be precise depending on at which location the rotary screen 6 is located, as viewed in the transverse direction CMD of the endless strip 2.

In the version shown in FIG. 3, the circumferential speed Vu and transport speed Vt are coordinated incorporating the circumference of the endless strip 2, the angle α which the longitudinal axis 8 of the rotary screen 6 and the longitudinal direction MD of the endless strip 2 enclose with each other and the length of the identical perforation pattern sections of the circular-cylindrical rotary screen 6, which perforation pattern sections are arranged consecutively in the circumferential direction of the surface area.

FIG. 4 shows a second version of the method according to the invention.

In the version illustrated in FIG. 4, the rotary screen 6 rolls on the circumferential side 3 in an uninterrupted, helical path B. The path B is formed by a multiplicity of mutually adjacent path revolutions BU, of which, in the present case, the path revolutions BU1' and BU2' are described in more detail. Each path revolution BU1', BU2' is delimited in the length thereof by a beginning A and an end E. For example, the path revolution BU1' is delimited in the length thereof by the beginning A1' and the end E1'. As can be seen from the illustration in FIG. 4, the ends E1', E2' and the beginnings A1', A2' of all of the path revolutions lie on a common straight line 18' which encloses an angle α=90° with the longitudinal direction MD of the endless strip 2. In this case, the beginnings A1', A2' and the ends E1', E2' of all of the path revolutions BU1', BU2' are therefore arranged on a common straight line 18' extending parallel to the transverse direction CMD of the endless strip 2. The beginning A1', A2' and the end E1', E2' of each path revolution BU1', BU2' are each offset with respect to each other here, as viewed in the transverse direction CMD of the endless strip, by the width BB of the path B, that is to say, for example, that the beginning A1' of the path revolution BU1', as viewed in the transverse direction CMD of the endless strip 2, is arranged offset from the end E1" of the path revolution BU1" by the path width BB.

During rolling of the rotary screen 6 on the circumferential side 3, said rotary screen is displaced in the transverse direction CMD of the endless strip 2 in such a manner that the adjacent path revolutions BU1', BU2' of the helical path B are added to the topographical pattern. Mutually adjacent path revolutions BU1' BU2' are arranged here abutting against each other.

In the present case, during rolling of the rotary screen 6 on the circumferential side 3, the longitudinal axis 8 of the rotary screen 6 is oriented parallel to the transverse direction CMD of the endless strip 2. Accordingly, in the present case, the longitudinal axis 8 of the rotary screen 6 encloses the angle α=90° with the longitudinal direction MD of the endless strip 2. This means that, when rolling on the circumferential surface 3, the rotary screen 6 rotates about the longitudinal axis 8 thereof which is oriented parallel to the transverse direction CMD of the endless strip 2.

In the case shown in FIG. 4, the beginning and end of each path revolution BU, as viewed in the longitudinal direction MD of the endless strip, always lie at the same location, i.e. during each revolution of the endless strip 2 around the two rolls 4, 5, one path revolution BU is also completed, to be precise independently of at which location the rotary screen 6 is located, as viewed in the transverse direction CMD of the endless strip 2.

FIG. 5 shows a third version of the method according to the invention.

In the version illustrated in FIG. 5, the rotary screen 6 rolls on the circumferential side 3 of the endless strip 2 in a plurality of paths B arranged next to one another, wherein each path B makes only one path revolution BU on the circumferential side 3 which is to be printed. That is to say, each path revolution BU produces a path B. Furthermore, the rotary screen 6 is displaced in the transverse direction of the endless strip 2 by the path width BB between the application of two paths BU1", BU2", BU3" arranged next to each other.

In the version shown in FIG. 5, the beginning A1", A2" and the end E1", E2" of each path revolution BU", BU2" are not offset with respect to each other, as viewed in the transverse direction CMD of the endless strip 2.

As can be seen from the illustration in FIG. 5, the ends E1", E2" and the beginnings A1", A2" of all of the path revolutions lie on a common straight line 18" which encloses an angle α=90° with the longitudinal direction MD of the endless strip 2. In this case, the beginnings A1", A2" and the ends E1", E2" of all of the path revolutions BU1", BU2" are therefore arranged on a common straight line 18" extending parallel to the transverse direction CMD of the endless strip 2.

Between the production of successive path revolutions BU1", BU2", the rotary screen 6 on the circumferential side 3 is displaced in the transverse direction CMD of the endless strip 2 in such a manner that the adjacent path revolutions BU1", BU2" are added to the topographical pattern. In this case, mutually adjacent path revolutions BU1", BU2" are arranged abutting against each other. During the production of the path revolutions BU1", BU2", the rotary screen 6 is not displaced in the transverse direction CMD of the endless strip 2. The rotary screen 6 is therefore moved in the transverse direction CMD only if the rotary screen has produced a closed path BU1", BU2" and has to be brought into a position for producing an adjacent path.

In the present case, during rolling of the rotary screen 6 on the circumferential side 3, the longitudinal axis 8 of the rotary screen 6 is oriented parallel to the transverse direction CMD of the endless strip 2. Accordingly, in the present case, the longitudinal axis 8 of the rotary screen 6 encloses the angle α=90° with the longitudinal direction MD of the endless strip 2. This means that, during rolling on the circumferential side 3, the rotary screen 6 rotates about the longitudinal axis 8 thereof which is oriented parallel to the transverse direction CMD of the endless strip 2.

In the case shown in FIG. 5, the beginning and end of each path revolution BU, as viewed in the longitudinal direction MD of the endless strip, always lie at the same location, i.e., during each revolution of the endless strip 2 around the two rolls 4, 5, a path revolution BU is also completed, to be precise independently of at which point the rotary screen 6 is located, as viewed in the transverse direction CMD of the endless strip 2.

Figure 6:
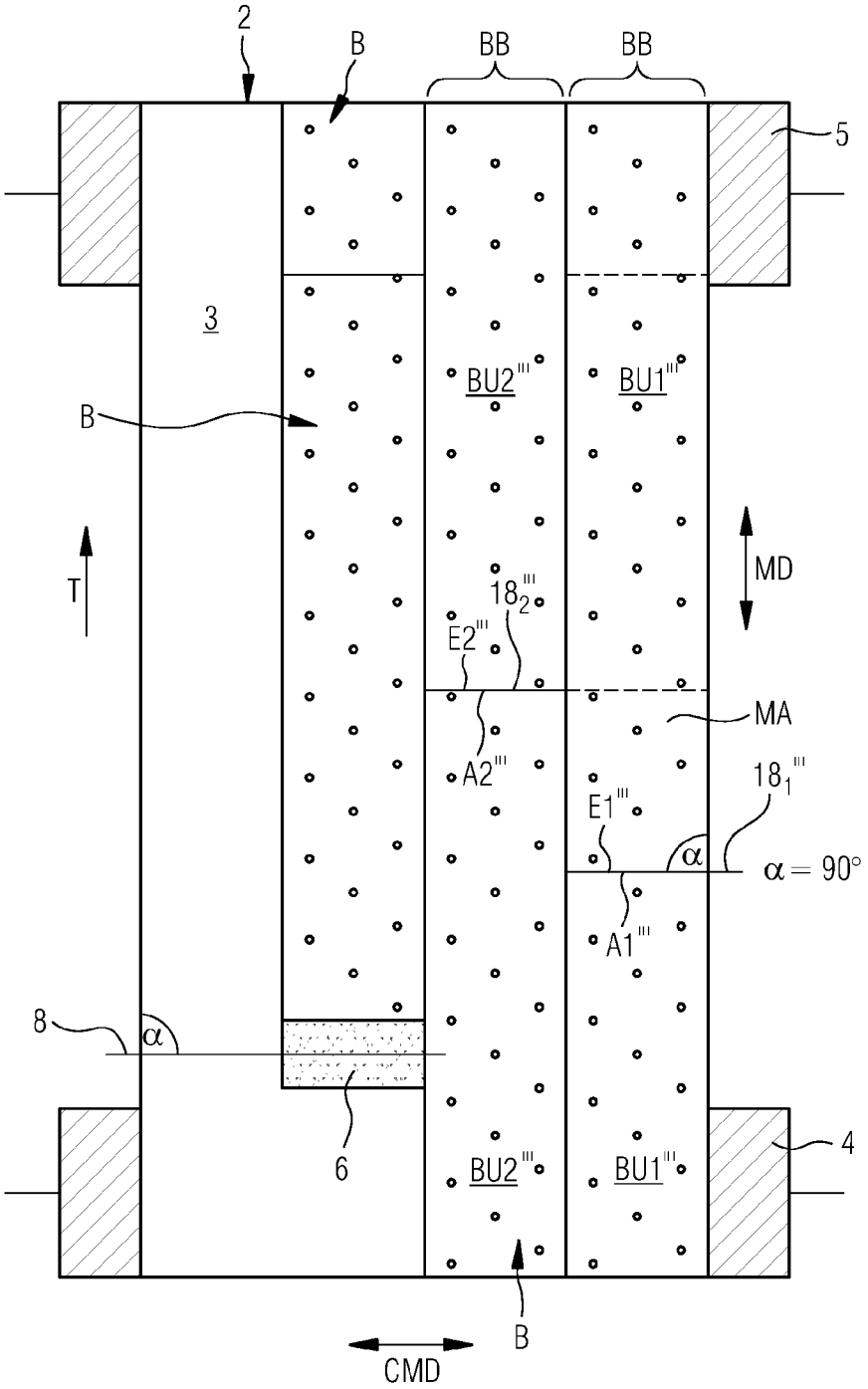
FIG. 6 shows a fourth version of the method according to the present invention.

FIG. 6 shows a fourth version of the method according to the invention.

In the version illustrated in FIG. 6, the rotary screen 6 rolls on the circumferential side 3 of the endless strip 2 in a plurality of paths B arranged next to one another, wherein each path B makes only one path revolution BU on the circumferential side 3 which is to be printed. That is to say, each path revolution BU produces a path B. Furthermore, the rotary screen 6 is displaced in the transverse direction of the endless strip 2 by the path width BB between the application of two paths BU1", BU2", BU3" arranged next to one another.

In the version shown in FIG. 6, the beginning A1'" and the end E1'" of the path revolution BU1'" lie on a common straight line $\mathbf{18}_1$'". Furthermore, the beginning A2'" and the end E2'" of the path revolution BU2'" lie on a common straight line $\mathbf{18}_2$'" which runs in a manner oriented parallel to the straight line $\mathbf{18}_1$'". In contrast to the exemplary embodiment shown in FIG. 5, in the exemplary embodiment in FIG. 6 only the beginning and the end of each path revolution BU1'", BU2'", as viewed by themselves, in each case lie on a common straight line rather than all of the beginnings and ends of the path revolutions.

In the present case, the straight lines $\mathbf{18}_1$'" and $\mathbf{18}_2$'", as viewed in the longitudinal direction MD of the endless strip 2, are offset with respect to each other by the length of a topographical pattern section MA applied on the circumferential side of the endless strip 2—in general by an integral multiple of the length of a topographical pattern section.

In the present case—as in the exemplary embodiment in FIG. 5—during rolling of the rotary screen 6 on the circumferential side 3, the longitudinal axis 8 of the rotary screen 6 is oriented parallel to the transverse direction CMD of the endless strip 2. Accordingly, in the present case, the longitudinal axis 8 of the rotary screen 6 encloses the angle $\alpha$=90° with the longitudinal direction MD of the endless strip 2. This means that, during rolling on the circumferential side 3, the rotary screen 6 rotates about the longitudinal axis 8 thereof which is oriented parallel to the transverse direction CMD of the endless strip 2.

In the versions shown in FIGS. 4, 5 and 6, the circumferential speed Vu of the surface area of the rotary screen 6 and the transport speed Vt of the endless strip 2 are coordinated taking into consideration the quotient of the circumference of the endless strip 2 and the length of the identical perforation pattern sections of the circular-cylindrical rotary screen 6, which perforation pattern sections are arranged consecutively in the circumferential direction of the surface area.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for producing a topographical pattern of a polymer material on an endless strip which has a longitudinal direction and a transverse direction extending perpendicularly thereto, said method comprising the steps of:

providing a rotary screen including a surface area, said surface area being cylindrical and having a perforation pattern which defines the topographical pattern, said perforation pattern, viewed in a circumferential direction of said surface area, being formed by one of one perforation pattern section and a plurality of consecutive and identical perforation pattern sections;

pressing the polymer material, in order to produce the topographical pattern on a circumferential side of the endless strip, in one of a liquid state and a pasty state through a plurality of perforations in said surface area of said rotary screen while said rotary screen, rotating repeatedly about a longitudinal axis of said rotary screen, rolls on said circumferential side of the endless strip in at least one path revolving at least once uninterruptedly on said circumferential side of the endless strip;

arranging, for each path revolution of said rotary screen on a circumferential surface of the endless strip, a beginning and an end of a respective said path revolution along a common straight line, a plurality of said beginning and a plurality of said end of all of a plurality of said path revolution being arranged along said common straight line; and rolling said rotary screen such that, when rolling, said rotary screen makes N/M revolutions about said longitudinal axis of said rotary screen during each said path revolution on said circumferential side of the endless strip, with said N and said M each being a positive whole number, said N being a total number of said perforation pattern sections which roll on said circumferential side of the endless strip from said beginning to said end of said respective path revolution of said rotary screen on said circumferential side of the endless strip, and with said M indicating a number of said perforation pattern sections which are arranged consecutively in said circumferential direction of said surface area of said rotary screen, when rolling on said circumferential side, said surface area of said rotary screen rotating at a circumferential speed while the endless strip revolves at a transport speed, which is oriented parallel to the longitudinal direction thereof, about at least two rolls which are spaced apart from each other and are oriented parallel to each other, said circumferential speed and said transport speed being coordinated with each other in such a manner that said rotary screen makes N/M revolutions about a rotational axis thereof during each said path revolution on said circumferential surface of the endless strip and said N and said M are in each case a positive whole number, said circumferential speed and said transport speed being coordinated taking into consideration a quotient of a length of one of said plurality of path revolutions and a length of one of said plurality of consecutive and identical perforation pattern sections of said surface area of said rotary screen.

2. The method as claimed in claim 1, wherein said common straight line along which said plurality of beginnings and said plurality of ends of all of said plurality of path revolutions are arranged runs in the transverse direction of the endless strip.

3. The method as claimed in claim 1, wherein said common straight line along which said plurality of beginnings and said plurality of ends of all of said plurality of path revolutions are arranged encloses an angle of greater than 0° and smaller than 90° with the transverse direction of the endless strip.

4. The method as claimed in claim 1, wherein said rotary screen extends only over part of a width of the endless strip.

5. The method as claimed in claim 1, wherein, during rolling of said rotary screen on said circumferential side, said longitudinal axis of said rotary screen is oriented perpendicularly to the longitudinal direction of the endless strip.

6. The method as claimed in claim 1, wherein said rotary screen rolls on said circumferential surface in an uninterrupted, helical path, and, when rolling on said circumferential side, said rotary screen is displaced in the transverse direction of the endless strip in such a manner that adjacent ones of said plurality of path revolutions of said helical path are added to the topographical pattern.

7. The method as claimed in claim 1, wherein said rotary screen rolls on said circumferential surface in an uninterrupted, helical path over an entire width of the endless strip, and, when rolling on said circumferential side, said rotary screen is displaced in the transverse direction of the endless strip in such a manner that adjacent ones of said plurality of path revolutions of said helical path are added to the topographical pattern.

8. The method as claimed in claim 1, wherein said rotary screen is rolled on said circumferential side of the endless strip in a plurality of said path arranged next to one another, with each one of said plurality of paths making only one said path revolution on said circumferential side to be printed, and, between an application of two of said plurality of paths arranged next to each other, said rotary screen is displaced in a direction of a width of the endless strip.

9. The method as claimed in claim 1, wherein said rotary screen is rolled on said circumferential side of the endless strip in a plurality of said path arranged next to one another, with each one of said plurality of paths making only one said path revolution on said circumferential side to be printed, and, between an application of two of said plurality of paths arranged next to each other, said rotary screen is displaced in a direction of a width of the endless strip by a path width.

10. The method as claimed in claim 1, wherein, during rolling of said rotary screen on said circumferential side, said longitudinal axis of said rotary screen is oriented at an angle of greater than 0° with respect to the transverse direction of the endless strip.

11. The method as claimed in claim 10, wherein said rotary screen rolls on said circumferential surface in an uninterrupted, helical path, and, when rolling on said circumferential side, said rotary screen is displaced in the transverse direction of the endless strip in such a manner that adjacent ones of said plurality of path revolutions of said helical path are added to the topographical pattern.

12. The method as claimed in claim 10, wherein said rotary screen rolls on said circumferential surface in an uninterrupted, helical path over an entire width to be coated of the endless strip, and, when rolling on said circumferential side, said rotary screen is displaced in the transverse direction of the endless strip in such a manner that adjacent ones of said plurality of path revolutions of said helical path are added to the topographical pattern.

13. The method as claimed in claim 1, wherein said circumferential speed and said transport speed are coordinated in such a manner that, given said quotient of said length of one of said plurality of path revolutions and said length of one of said plurality of consecutive and identical perforation pattern sections of said surface area of said rotary screen that is not equal to a positive whole number, said circumferential speed and said transport speed are not equal.

14. The method as claimed in claim 1, wherein said rotary screen is arranged at a location at which the endless strip is not guided around a roll.

15. The method as claimed in claim 1, wherein said perforation pattern of said rotary screen which defines the topographical pattern, as viewed in a longitudinal extent of said rotary screen, is delimited by an end on a first end side of said perforation pattern and an end on a second end side of said perforation pattern, said end on said first end side of said perforation pattern constituting a continuation of said end on said second end side of said perforation pattern.

* * * * *